United States Patent [19]

Wolgast et al.

[11] 4,057,994

[45] Nov. 15, 1977

[54] AUTOMOBILE BODY PULLING TOOL

[75] Inventors: Raymond P. Wolgast, Bloomfield Hills; Joe Lamanna, Troy, both of Mich.

[73] Assignee: Detroit Autobody Equipment, Inc., Troy, Mich.

[21] Appl. No.: 651,544

[22] Filed: Jan. 22, 1976

[51] Int. Cl.[2] ..... B21D 1/12

[52] U.S. Cl. ..... 72/441; 72/705

[58] Field of Search ..... 72/705, 457, 441; 254/124, 133

[56] References Cited

U.S. PATENT DOCUMENTS

| | | | |
|---|---|---|---|
| 3,027,930 | 4/1962 | Padgett | 72/705 X |
| 3,719,347 | 3/1973 | Wolgast | 72/705 X |
| 3,817,081 | 6/1974 | Morski | 72/705 X |
| 3,927,550 | 12/1975 | Samuelsson | 72/705 X |
| 3,935,725 | 2/1976 | Reischl | 72/705 X |

FOREIGN PATENT DOCUMENTS

| | | | |
|---|---|---|---|
| 2,145,992 | 3/1973 | Germany | 72/705 |
| 329,131 | 1/1971 | Sweden | 72/705 |

*Primary Examiner*—Victor A. DiPalma

*Assistant Examiner*—D. M. Gurley

*Attorney, Agent, or Firm*—Harness, Dickey & Pierce

[57] ABSTRACT

An apparatus is disclosed for applying a pulling force to an automobile body or the like, the apparatus including a generally upright column member adapted to be secured via a chain or similar flexible element to a portion of a vehicle body, the lower end of the column being supported by a support base structure including a pair of upstanding members spaced apart a distance approximately equal to the width of the lower end of the column and adapted to have the lower end of the column received therebetween, the upstanding members and the lower end of the column being formed with pairs of vertically spaced aligned bores adapted to receive a pair of pins for either lockingly securing the column in a generally upright and vertical position or permitting pivotal movement of the column relative to the base structure, whereby the apparatus may be used as a relatively rigid anchor structure in one mode of operation thereof, and in an alternative mode of operation thereof, may be used in conjunction with a force-applying mechanism, such as a piston and cylinder assembly for exerting a pulling force upon the associated vehicle body.

5 Claims, 5 Drawing Figures

AUTOMOBILE BODY PULLING TOOL

BACKGROUND AND SUMMARY OF THE INVENTION

Repairs to vehicles that have been damaged from a collision or the like are rendered difficult by the inability to conveniently apply a force to the damaged body or frame components to force the damaged parts toward their original undamaged position or condition. In many instances, the damage to the vehicle includes a substantial portion thereof, such as a door, quarterpanel, deck, as well as the vehicle frame per se. The prior art is repleat with a myriad of different types of devices for repairing vehicles; unfortunately, however, most of such prior art devices are either of the stationary or portable type, and while the stationary type straightening tools are satisfactory for certain types of body repairing operations, usually such apparatus involve many components and are therefor too expensive for the small shop owner. The portable-type tools, on the other hand, are frequently inadequate for major repair work for the reason that the devices cannot be attached and pressure applied at the required locations. Moreover, because of the costs involved in such prior art apparatus, many small shop owners find it difficult to possess both the portable and stationary-type tools and hence are limited as to their repairing capability.

The present invention is directed toward a new and improved apparatus which can be used in both a portable and stationary mode of operation, whereby to provide for universality of application and satisfy the requirement for both portable and stationary applications. Consequently, the present invention obviates the need for a shop owner to be subjected to purchasing both stationary and portable-type equipment, but does not in any way limit such shop owner as to the type of repair jobs which he can perform.

It is accordingly a general object of the present invention to provide a new and improved automobile repair apparatus which, in one mode of operation, can be used as a stationary straightening tool, and in a second mode of operation, can be used as a portable-type of straightening tool.

It is a more particular object of the present invention to provide a new and improved automobile repair apparatus of the above-described type which may be utilized as a stationary column and by which a force may be applied to an associated automobile through a suitable force-applying mechanism, such as a chain-type come-along.

It is another object of the present invention to provide an automobile repair apparatus of the aforesaid type which may be used in a portable or movable sense and may be made to move or pivot about a predetermined axis by means of an hydraulically actuated piston and cylinder assembly, whereby to apply a pulling force to a portion of an automobile vehicle.

It is a further object of the present invention to provide a new and improved apparatus of the above-described type which is relatively simple in design, is economical to manufacture and will have a long and effective operational life.

Other objects and advantages of the present invention will become apparent from the following detailed description taken in conjunction with the accompanying drawing.

DETAILED DESCRIPTION OF A PREFERRED EMBODIMENT

Figure 1:
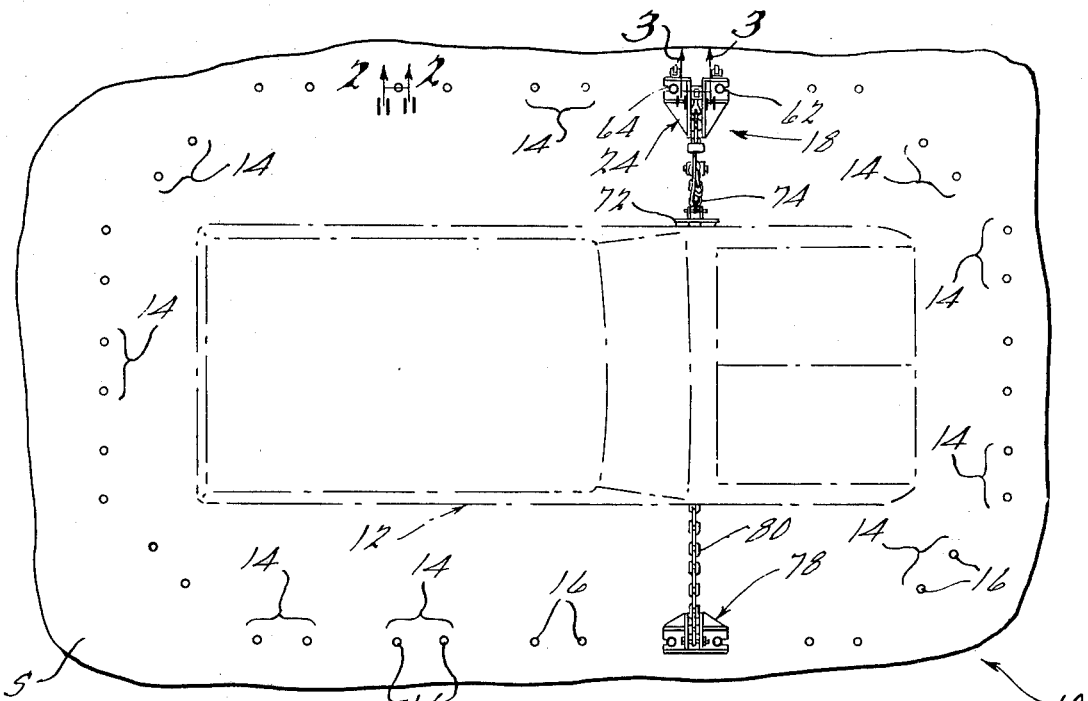
FIG. 1 is a top elevational view of the apparatus of the present invention, as shown in operative association with a typical vehicle which is to be subjected to a repair operation.
Figure 2:
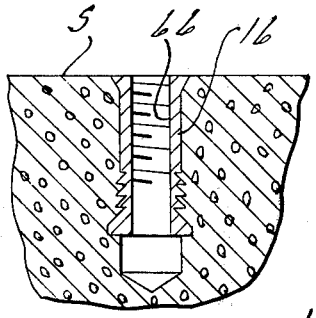
FIG. 2 is an enlarged fragmentary cross-sectional view taken substantially along the line 2—2 of FIG. 1.

Referring now in detail to the drawing and in particular to FIG. 1 thereof, a vehicle repair installation 10 is shown in operative association with a typical automotive vehicle 12 which is to be subjected to a repair operation. The installation 10 includes a plurality of mounting stations 14 which are arranged circumjacent the vehicle 12, as best seen in FIG. 1. Each of the mounting stations 14 comprises a pair of anchor elements 16 which are adapted to selectively secure a force-applying assembly 18, which is constructed in accordance with the principles of the present invention, to or upon the support surface S upon which the vehicle 12 is resting. Generally speaking, the force-applying assembly 18 is mounted at a selected one of the mounting stations 14 and is connected to a portion of the vehicle body, whereupon a force is exerted by means of the assembly 18 to cause the portion of the body to be moved or deformed toward some predetermined configuration. By virtue of the plurality of mounting stations 14 around the vehicle 12, the assembly 18 may be located at any one of a number of mounting stations 14, depending upon the portion of the body of the vehicle 12 which is to be repaired.

Figure 3:
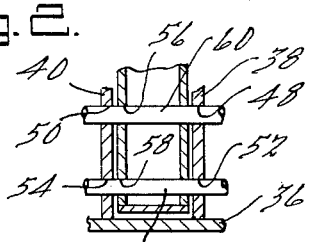
FIG. 3 is an enlarged fragmentary cross-sectional view taken substantially along the line 3—3 of FIG. 1.
Figure 4:
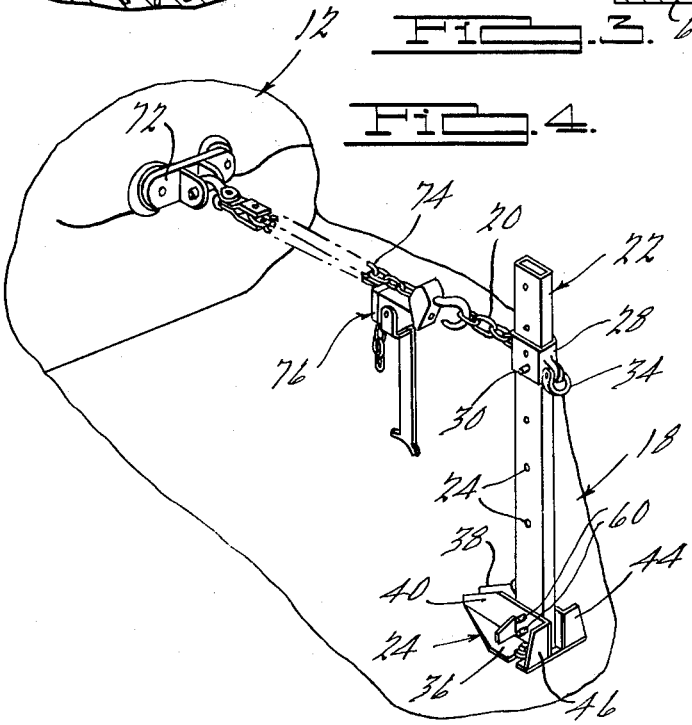
FIG. 4 is an elevated perspective view of the apparatus of the present invention in one mode of operation thereof.
Figure 5:
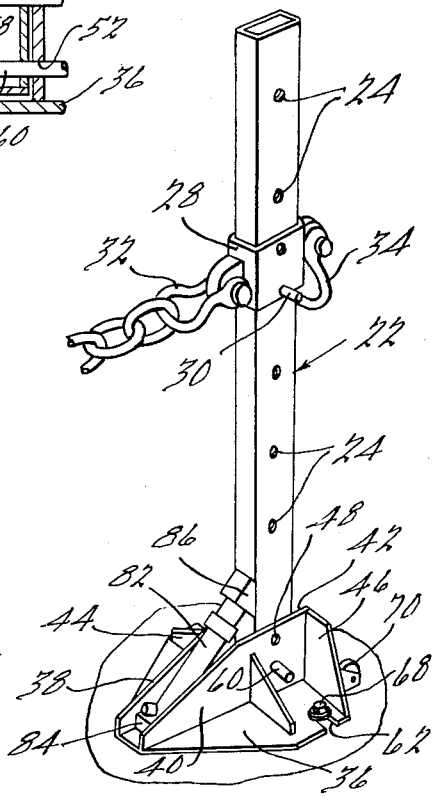
FIG. 5 is an elevated perspective view of the apparatus of the present invention in a second mode of operation theroef.

Referring now in detail to the construction of the assembly 18, as best shown in FIGS. 3-5, the assembly 18 comprises a generally upright column member 22 which is fabricated of a box channel construction. The column member 22 is associated with a support base, generally designated by the numeral 24, and is formed with a plurality of vertically-spaced openings or apertures 26. A vertically adjustable connecting bracket 28 is slidably supported upon the column member 22 and is intended to be affixed at any predetermined vertical position thereon by means of suitable locking pins or the like 30 which are adapted to extend through the bracket 28 and selected of the apertures 26 in the column member 22. One or more fastening loops 32, 34 may be provided on the bracket 28 by which the bracket 28 may be connected to the vehicle 12 in a manner to be hereinafter described.

The support base 24 generally comprises a base plate 36 which is adapted to be secured directly to the surface S at the various mounting stations 14. Disposed upon the plate 36 is a pair of spaced-apart upstanding members 38, 40 which are secured to the plate 36 as by welding and define a recess 42 therebetween. Suitable reinforcing webs or ribs 44, 46 are secured to the laterally outer side of each of the members 38, 40 and are secured thereto as well as to the base plate 36 as by welding or the like in order to strengthen or rigidify the members 38, 40. As best seen in FIG. 3, the members 38, 40 are formed with a pair of aligned upper openings 48, 50 and with a pair of aligned lower openings 52, 54. The openings 48, 52 and 50, 54, respectively, are generally vertically aligned and are adapted to be selectively axially aligned with the upper and lower openings 56, 58 formed in the lower end of the column member 22 when the same is disposed within the recess 42, as best seen in FIGS. 3–5. A pair of retaining pins 60 are adapted to be inserted through the aligned openings 48, 52 and 56 and 50, 54 and 58, as best seen in FIG. 3 for fixedly securing the column member 22 in a generally upright position shown in the drawings, for purposes hereinafter to be described.

The base plate 36 is formed with a pair of opposed recesses 62, 64 which are adapted to be selectively aligned with a pair of bores 66 formed in the surface S at each of the stations 14 and within which the anchor elements 16 are nestingly received. Means in the form of suitable screws, bolts or the like 68 are intended to extend through the recesses 62, 64 and be threaded into the anchor elements 66 for fixedly securing the base plate 36 and hence the entire assembly 18 in the manner best shown in FIGS. 2–5. In a preferred construction of the present invention, a pair of castors, generally designated by the numeral 70, are provided on the support base 24 for facilitating transport of the assembly 18 between the repair installation 10 and a suitable storage area, as well as facilitating movement of the assembly 18 to and from the various mounting stations 14.

In accordance with the principles of the present invention, assuming that the assembly 18 is to be used as a stationary column, each of the pins 60 is inserted within their respective openings in the column member 22 and support base 24, whereby to rigidly secure the member 22 in the vertical position shown, for example, in FIG. 4. A suitable attachment means, such as a vacuum cup or the like, designated by the numeral 72 in FIG. 4, is then secured to the portion of the vehicle body to which a pulling force is to be applied. The vacuum cup 72 may be of any suitable construction, such as that shown in United States Patent No. 3,728,891 which is owned by the assignee hereof. The vacuum cup 72 is then connected to the assembly 18 by means of a suitable flexible member 74, such as a chain, and a chain tensioning device or come-along mechanism 76, to the bracket 28 on the column member 22. Assuming that the assembly 18 is properly secured at one of the mounting stations 14, actuation of the come-along 76 will cause the chain 74 to be tensioned, whereupon a pulling force will be exerted against the portion of the vehicle body to which the vacuum cup 72 is secured, thereby deforming the portion of the vehicle body to some predetermined degree, the extent of which may be controlled by the amount of actuation of the come-along 76, as will be appreciated by those skilled in the art. In certain instances, it may be desirable to anchor the opposite side of the vehicle to the support surface S when pulling forces in excess of a predetermined magnitude are exerted against the vehicle 12. Under such circumstances, a suitable anchor assembly 78, as seen in FIG. 1, may be secured to one of the mounting stations 14 on the opposite side of the vehicle 12 from the assembly 18 and secured to the vehicle 12 by means of a suitable chain or the like 80, as will be appreciated by those skilled in the art.

At such time as the assembly 18 is to be used as a relatively movable force-applying means, one of the pins 60 may be removed from the associated of the openings in the column member 22 and support base 24, whereupon the upper end of the column member 22 will be pivotably supported for movement about a horizontal axis extending through the remaining of the pins 60. In this application, means in the form of a suitable force-applying mechanism, such as a hydraulically or pneumatically actuated piston and cylinder assembly 82, is associated with the pivotal column member 22. In particular, such a force-applying mechanism 82 is preferably, although not necessarily, secured, as seen at 84, to the support base 24 between the members 38, 40, while the opposite end of the mechanism 82 is secured, as seen at 86, to the lower end of the column member 22. At such time as the mechanism 82 is properly actuated, for example, by pumping a pressurized fluid thereto, the mechanism 82 will cause the upper end of the column 22 to be pivotally biased away from the associated vehicle 12. Accordingly, a pulling force will be exerted on the vehicle, for example, by means of a suitable vacuum cup connecting mechanism, such as the mechanism 72 and a suitable chain, such as the chain 76, to produce a pulling force or action against the vehicle body. At such time as a predetermined amount of pulling force has been exerted against the body, the mechanism 82 may be deactuated (depressurized), whereby to facilitate disassembly of the vacuum cup 72 from the vehicle body for repositioning or the like during a subsequent force-applying operation. It may be desirable, of course, to utilize the ancillary anchor assembly 78 and chain 80 when the column member 22 is used in a movable or pivotal fashion, as above described, depending upon the type and magnitude of force to be exerted against the vehicle 12.

It will be seen from the foregoing that the present invention provides a novel force-applying assembly which may be used not only as a fixed column, but also as a movable member, movement of which is effected by a suitable ancillary source of power, such as the piston and cylinder mechanism 82. Accordingly, the single assembly 18 will find wide and universal use in various types of vehicle repairing applications, thereby minimizing the amount of expenditures to which a repair shop owner must be subjected in order to have the requisite equipment for complete body repairing operations, By virtue of the fact that the assembly 18 is of a relatively simple design, manufacturing costs thereof will be minimized to the extreme. Likewise, the assembly 18 of the present invention will have a long and effective operational life and require extremely infrequent maintenance and/or repair.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

We claim:

1. An apparatus for applying a pulling force to a surface to be reshaped, said apparatus comprising a generally upright column member, means on said column securing a pulling element extending between said colunn and said surface to be reshaped, a support base structure for said column and including a base plate adapted to be fixedly secured to a support surface provided with pairs of spaced openings or the like, said base structure being arranged generally horizontally and formed with a pair of inwardly projecting recesses adapted to receive mounting bolts for securing the same to any one of said pairs of openings in said surface, said support base including a pair of upright vertical members welded thereto and spaced apart a distance sufficient to define a recess approximately equal to the width of one of said column and having said one end of said column nestingly disposed therebetween, said upright members being formed with first and second generally vertically aligned pairs of apertures, said one end of said column being formed with a first opening aligned with said first pair of apertures and with a second opening aligned with said second pair of apertures, a first elongated generally cylindrically-shaped pin-like member positionable in a generally horizontal attitude within said first pair of apertures and said first opening and defining a pivotal axis about which said column is pivotable relative to said base structure, a second elongated generally cylindrically-shaped pin-like member selectively positionable in spaced parallelism relative to said first member and disposed within said second pair of apertures and said second opening simultaneously when said first member is positioned within said first pair of apertures and said first opening, whereby to fixedly secure said column in a generally vertical orientation upon said base structure, and force applying means secured to a lower portion of said column and to said base structure whereby said base structure and column are pivoted relative to each other when applying a force to said column to thereby apply a pulling force to the surface to be reshaped by said pulling element when one of said pin-like members is removed.

2. An apparatus as set forth in claim 1 wherein said means on said column securing a pulling element thereto includes a support bracket mounted on said column.

3. An apparatus as set forth in claim 1 wherein said means for applying a pivotable force comprises a pressure actuated piston and cylinder assembly, one end of said assembly being secured to said base structure and the opposite end of said assembly being secured to said column.

4. An apparatus as set forth in claim 3 wherein said piston and cylinder assembly is located between said upright members on said base structure.

5. An apparatus as set forth in claim 2 which includes means for securing said connecting bracket at selected vertical positions along said column.

* * * * *